US010132014B2

(12) United States Patent
Yamada et al.

(10) Patent No.: US 10,132,014 B2
(45) Date of Patent: Nov. 20, 2018

(54) WOVEN FABRIC

(71) Applicants: TOYOTA BOSHOKU KABUSHIKI KAISHA, Aichi-ken (JP); DAIKI CO., LTD., Fukui-ken (JP)

(72) Inventors: Takamasa Yamada, Aichi-ken (JP); Atsuhiko Ito, Aichi-ken (JP); Takayoshi Yamamoto, Fukui-ken (JP)

(73) Assignees: TOYOTA BOSHOKU KABUSHIKI KAISHA, Aichi-Ken (JP); DAIKI CO., LTD., Fukui-Ken (JP)

( * ) Notice: Subject to any disclaimer, the term of this patent is extended or adjusted under 35 U.S.C. 154(b) by 28 days.

(21) Appl. No.: 15/600,097

(22) Filed: May 19, 2017

(65) Prior Publication Data

US 2017/0342608 A1 Nov. 30, 2017

(30) Foreign Application Priority Data

May 27, 2016 (JP) ..... 2016-106299

(51) Int. Cl.

| | |
|---|---|
| ***D03D 15/00*** | (2006.01) |
| ***F21V 8/00*** | (2006.01) |
| ***D03D 41/00*** | (2006.01) |
| *D03D 25/00* | (2006.01) |

(52) U.S. Cl.

CPC ..... *D03D 15/00* (2013.01); *D03D 15/0094* (2013.01); *D03D 41/00* (2013.01); *D10B 2401/20* (2013.01)

(58) Field of Classification Search

CPC ..... G02B 6/001; G02B 6/04; G02B 6/0006; G02B 6/0005; G02B 27/0994; G02B 6/08; D03D 15/00; D03D 1/0088; D03D 15/0011; D03D 15/0077; D03D 13/004; D03D 15/0027; D03D 1/00; D03D 25/00

See application file for complete search history.

(56) References Cited

U.S. PATENT DOCUMENTS

| | | | | |
|---|---|---|---|---|
| 8,129,294 | B2 * | 3/2012 | Khokar | D02G 3/06 442/185 |
| 8,408,766 | B2 * | 4/2013 | Wilson | B60Q 3/68 362/496 |
| 8,469,562 | B2 * | 6/2013 | Marzorati | B60Q 3/78 362/488 |

(Continued)

FOREIGN PATENT DOCUMENTS

| | | |
|---|---|---|
| JP | 2006-39287 | 2/2006 |
| JP | 2010-267573 | 11/2010 |

OTHER PUBLICATIONS

U.S. Appl. No. 15/600,055 to Takamasa Yamada et al., filed May 19, 2017.

*Primary Examiner* — Bobby Muromoto, Jr.
(74) *Attorney, Agent, or Firm* — Greenblum & Bernstein, P.L.C.

(57) ABSTRACT

In a woven fabric woven from first constituent yarns as one of warps and wefts and second constituent yarns as the other, a part of the first constituent yarns are 2 to 15 side emission type optical fibers woven in juxtaposition, and, when the number of the side emission type optical fibers is 3 or more, a twist-preventing yarn having a diameter smaller than that of the side emission type optical fibers is interposed between the one or two side emission type optical fibers and the one or two side emission type optical fibers.

10 Claims, 5 Drawing Sheets

(56) References Cited

U.S. PATENT DOCUMENTS

| | | | | |
|---|---|---|---|---|
| 2003/0156426 | A1* | 8/2003 | Givoletti | B60R 13/02 362/556 |
| 2004/0037091 | A1* | 2/2004 | Guy | D03D 15/00 362/582 |
| 2005/0146076 | A1* | 7/2005 | Alexander | D03D 1/0088 264/257 |
| 2005/0223464 | A1* | 10/2005 | Huang | A41D 13/01 2/102 |
| 2006/0087864 | A1* | 4/2006 | Peng | B60Q 1/56 362/554 |
| 2007/0103928 | A1* | 5/2007 | Goossen | D03D 1/0041 362/556 |
| 2014/0211498 | A1* | 7/2014 | Cannon | B60Q 3/54 362/555 |
| 2017/0217366 | A1* | 8/2017 | Kraemer | B60Q 3/54 |
| 2017/0261670 | A1* | 9/2017 | Yamada | G02B 6/0008 |
| 2017/0297484 | A1* | 10/2017 | Yamada | B60R 13/0243 |
| 2017/0342607 | A1* | 11/2017 | Yamada | D03D 15/00 |
| 2017/0343736 | A1* | 11/2017 | Yamada | G02B 6/001 |
| 2018/0017227 | A1* | 1/2018 | Greene | G02B 6/0006 |
| 2018/0023776 | A1* | 1/2018 | Greene | F21S 41/29 362/511 |
| 2018/0106446 | A1* | 4/2018 | Meier | D03D 1/00 |
| 2018/0162268 | A1* | 6/2018 | Yamada | D03D 15/0011 |

* cited by examiner

WOVEN FABRIC

CROSS-REFERENCE TO RELATED APPLICATIONS

The present application claims priority under 35 U.S.C. § 119 of Japanese Application No. 2016-106299 filed on May 27, 2016, the disclosure of which is expressly incorporated by reference herein in its entirety.

BACKGROUND

1. Technical Field

The present invention relates to a woven fabric which comprises a plurality of side emission type optical fibers woven in juxtaposition and which can prevent the deterioration in designability in vehicle compartments, for example, when used as a skin material for vehicle interior, due to a local rise in luminance caused by twisting and positional switching of the adjacent side emission type optical fibers, for example, in a light emission part formed of the side emission type optical fibers.

2. Related Art

The use of optical fibers is expanding in technical fields of optical communication and the like along with popularization of the Internet and the like. Based on the feature of optical fibers that they can guide light made incident from one end to the other end for light transmission, the optical fibers are used also in applications including, for example, various illuminations and displays. For example, there are known optical fibers having a core layer including an acrylic resin as the main ingredient and a fabric including the optical fibers, the optical fibers and fabric being useful, for example, as automobile accessories such as interior decoration goods, wherein damage inflicted to the core layer is suppressed; wherein a clad layer has been removed; and wherein an exposure position thereof is precisely processed (for example, see JP 2006-39287 A).

Also, there is known an optical fiber woven fabric including an optical fiber woven fabric including optical fibers and normal yarns woven as warps or wefts and a light source delivering light to at least one end part of the optical fibers, the optical fiber woven fabric functioning as an illumination device which allows for entrance of light from the light source into the optical fibers, and thus can be utilized as automobile interior parts such as door trims and small parts (for example, see JP 2010-267573 A). This literature explains that uneven light emission of the optical fiber woven fabric can be reduced by regularly weaving the optical fibers and the normal yarns in this optical fiber woven fabric to control the woven texture and emission luminance to be in predetermined states.

SUMMARY

The fabric having the optical fibers described in JP 2006-39287 A, is useful, for example, as automobile accessories such as interior decoration goods. In the optical fiber woven fabric described in JP 2010-267573 A, uneven light emission can be reduced by controlling the woven texture and emission luminance to be in predetermined states. JP 2006-39287 A and JP 2010-267573 A however, nowhere mention that the leakage of light from the circumferential edge part renders the dot-shaped light emission part indistinct and reduces the designability of the woven fabric.

The present invention has been made in light of the above-mentioned prior art situations, and an object thereof is to provide a woven fabric which comprises a plurality of side emission type optical fibers woven in juxtaposition and which can prevent the deterioration in designability in vehicle compartments, for example, when used as a skin material for vehicle interior, due to a local rise in luminance caused by twisting and positional switching of the adjacent side emission type optical fibers, for example, in a light emission part formed of the side emission type optical fibers.

In order to solve this problem, a first aspect of the invention is directed to a woven fabric woven from first constituent yarns as one of warps and wefts and second constituent yarns as the other, wherein a part of the first constituent yarns are 2 to 15 side emission type optical fibers woven in juxtaposition; and when the number of the side emission type optical fibers is 3 or more, a twist-preventing yarn having a diameter smaller than that of the side emission type optical fibers is interposed between the one or two side emission type optical fibers and the one or two side emission type optical fibers.

A second aspect of the invention is directed to the woven fabric according to the first aspect, wherein the 2 to 8 continuous side emission type optical fibers intersect the second constituent yarns on a non-design surface side, and a light emission part is formed of the side emission type optical fibers appearing on a design surface side.

A third aspect of the invention is directed to the woven fabric according to the first or second aspect, wherein the ratio ($d_1/d_2$) of the diameter ($d_1$) of the side emission type optical fibers to the diameter ($d_2$) of the twist-preventing yarn ranges from 1.2 to 20.0.

A fourth aspect of the invention is directed to any one of the first to third aspects, wherein the ratio ($f_1/f_2$) of the fineness ($f_1$) of the second constituent yarns to the fineness ($f_2$) of the twist-preventing yarn ranges from 0.05 to 20.0.

A fifth aspect of the invention is directed to any one of the first to fourth aspects, wherein the twist-preventing yarn is a multifilament made of a synthetic resin.

In the woven fabric of the present invention, a part of the first constituent yarns are 2 to 15 side emission type optical fibers woven in juxtaposition, and, when the number of the side emission type optical fibers is 3 or more, a twist-preventing yarn having a diameter smaller than that of the side emission type optical fibers is interposed between the one or two side emission type optical fibers and the one or two side emission type optical fibers. Thus, there is prevented the deterioration in designability due to a local rise in luminance caused by twisting and positional switching of the side emission type optical fibers aligned in juxtaposition so that the side emission type optical fibers cross to form convex parts at the twisted parts.

Also, when the 2 to 8 continuous side emission type optical fibers intersect the second constituent yarns on a non-design surface side and a light emission part is formed of the side emission type optical fibers appearing on a design surface side, a distinct light emission part can be formed, and, at the same time, the deterioration in designability due to a local rise in luminance at the time of light emission is sufficiently suppressed.

Further, when the ratio ($d_1/d_2$) of the diameter ($d_1$) of the side emission type optical fibers to the diameter ($d_2$) of the twist-preventing yarn ranges from 1.2 to 20.0, the light emission from the side emission type optical fibers would not be disturbed by the twist-preventing yarn, and the twist-preventing yarn is hardly recognized visually, thereby making it possible to produce a woven fabric having excellent designability.

Also, when the ratio ($f_1/f_2$) of the fineness ($f_1$) of the second constituent yarns to the fineness ($f_2$) of the twist-preventing yarn ranges from 0.05 to 20.0, a woven fabric having sufficient strength and the like can be produced. Although the tension which causes twisting of the side emission type optical fibers normally increases, the side emission type optical fibers would not be twisted or positionally switched by virtue of the twist-preventing yarn interposed between the side emission type optical fibers.

Further, when the twist-preventing yarn is a multifilament made of a synthetic resin, the designability would not be deteriorated, and the use of the multifilament is more advantageous in cost than the use of a monofilament.

Figure 1:
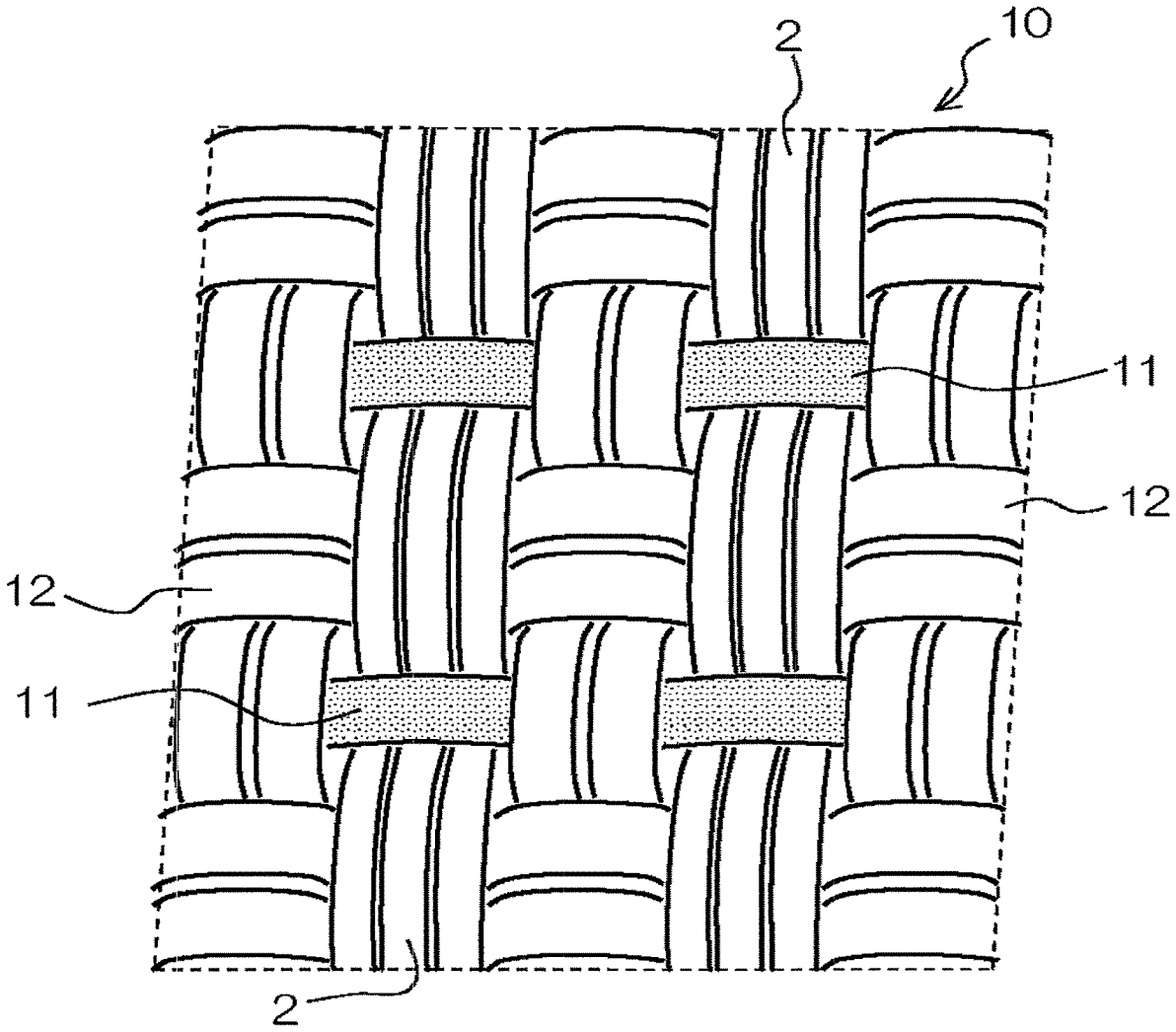
FIG. 1 is a schematic perspective view showing a part of a woven fabric comprising one side emission type optical fiber woven alone as a first constituent yarn.
Figure 2:
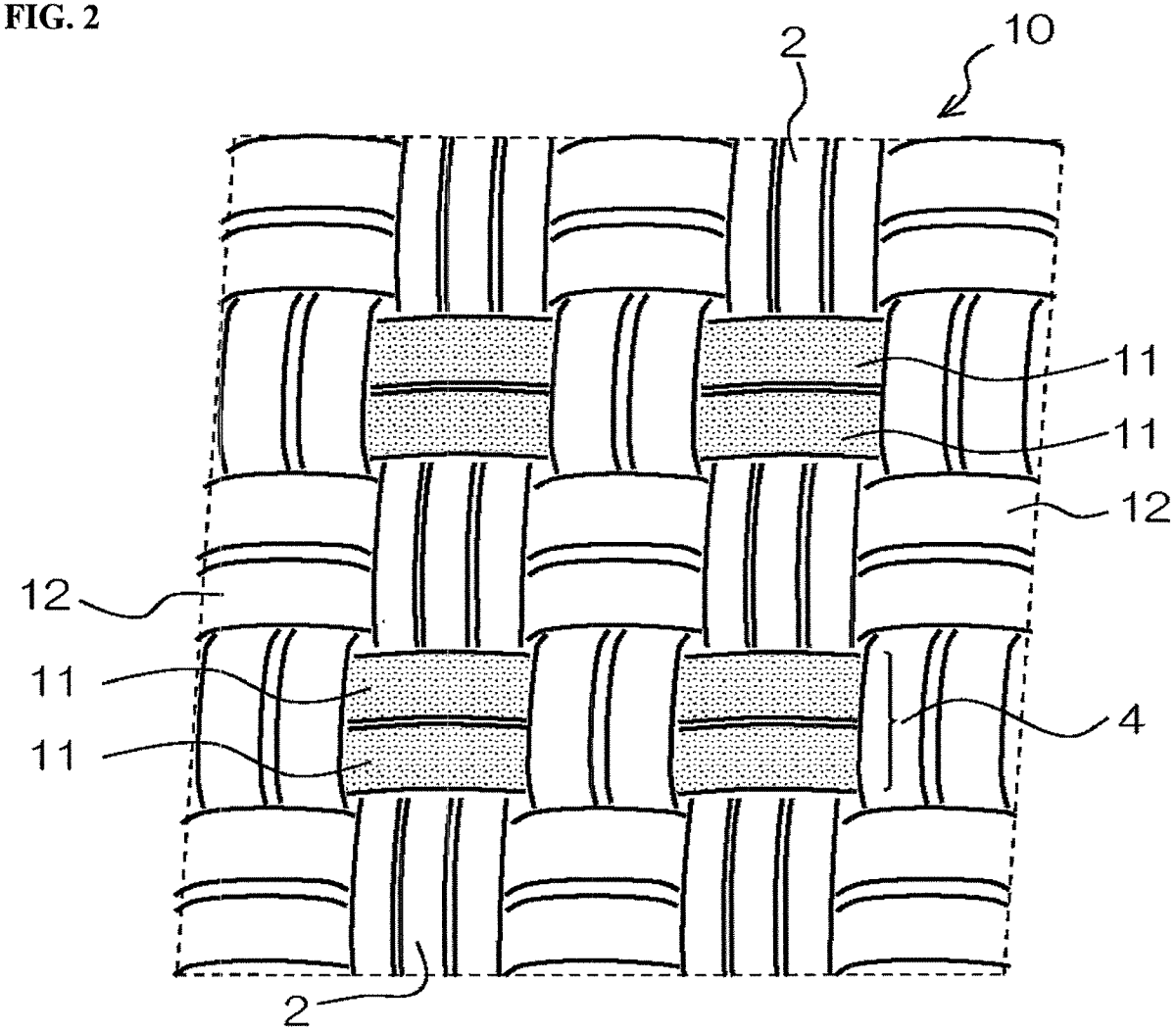
FIG. 2 is a schematic perspective view showing a part of a woven fabric comprising two side emission type optical fibers woven adjacent to each other as first constituent yarns.

It is noted that, in a woven fabric 10 shown in FIG. 2, two side emission type optical fibers 11 are woven adjacent to each other, as first constituent yarns 1. In this case, the twisting of the side emission type optical fibers 11 is suppressed by the tension of second constituent yarns 2 even without interposition of the twist-preventing yarn 3, so that the positions thereof would not be switched. However, since only two side emission type optical fibers 11 are juxtaposed, a small light emission part 4 is formed. Therefore, the woven fabric 10 cannot necessarily be said to be preferred from the viewpoint of designability.

DETAILED DESCRIPTION

Hereinafter, the present invention will be described in detail with reference to the drawings.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, and the description is taken with the drawings making apparent to those skilled in the art how the forms of the present invention may be embodied in practice.

A woven fabric 10 of the present invention is a woven fabric 10 woven from first constituent yarns as one of warps and wefts and second constituent yarns as the other. Also, a part of the first constituent yarns 1 are 2 to 15 side emission type optical fibers 11 woven in juxtaposition, and, when the number of the side emission type optical fibers 11 is 3 or more, a twist-preventing yarn 3 having a diameter smaller than that of the side emission type optical fibers 11 is woven and interposed between the one or two side emission type optical fibers 11 and the one or two side emission type optical fibers 11.

In the woven fabric 10, the side emission type optical fibers 11 are woven in juxtaposition, as a part of the first constituent yarns 1. The term "in juxtaposition" means that, when the first constituent yarns 1 are used as warps, two side emission type optical fibers 11 are adjacent in the warp direction, or are aligned almost in parallel with one twist-preventing yarn 3 being interposed between these side emission type optical fibers 11. On the other hand, this term means that, when the first constituent yarns 1 are used as wefts, two side emission type optical fibers 11 are adjacent in the weft direction, or are aligned almost in parallel with one twist-preventing yarn 3 being interposed between these side emission type optical fibers 11.

The number of the side emission type optical fibers 11 woven as a part of the first constituent yarns 1 is 2 to 15, preferably 3 to 12, more preferably 4 to 10. When the number of the side emission type optical fibers 11 is 2 (see FIG. 2), the twisting and positional switching of the side emission type optical fibers 11 caused by the tension of the second constituent yarns 2 are suppressed as described above. Further, there is no problem from the viewpoint of the strength of the woven fabric 10. However, a small light emission part 4 is formed, which is not preferred from the viewpoint of designability.

Figure 3:
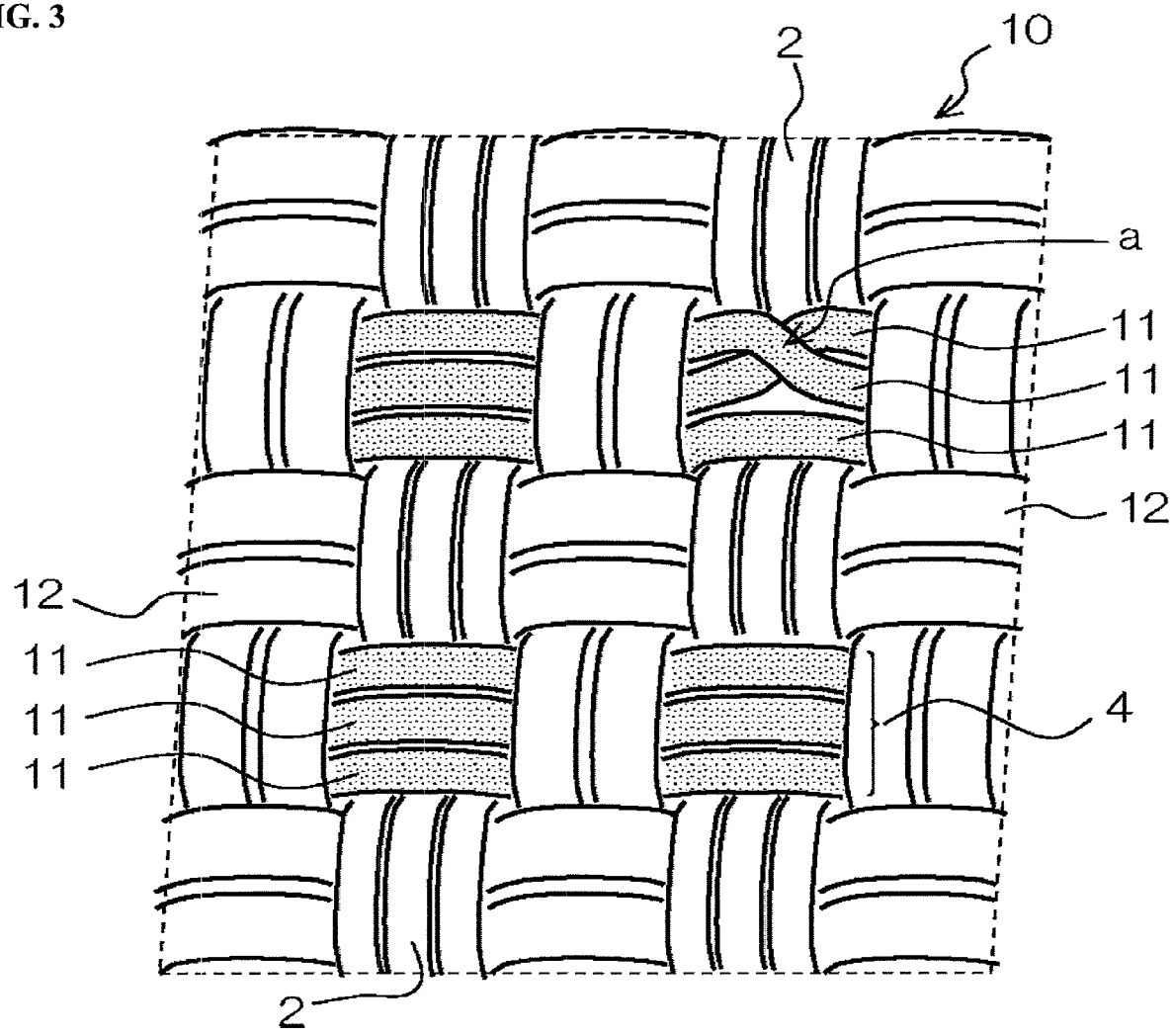
FIG. 3 is schematic perspective view showing a part of a woven fabric comprising three side emission type optical fibers woven adjacent to each other as first constituent yarns, in which the adjacent two side emission type optical fibers are twisted and positionally switched.
Figure 4:
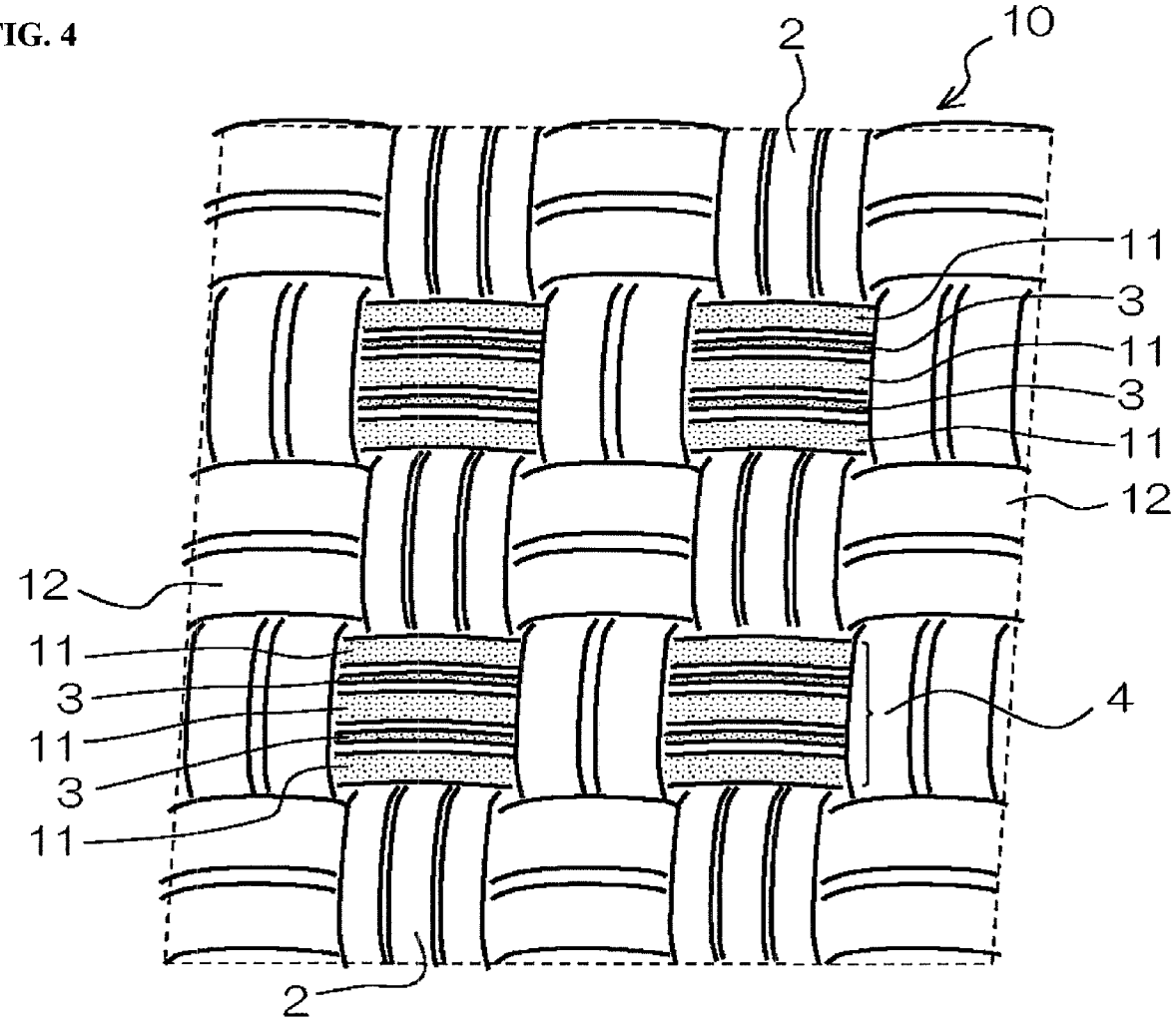
FIG. 4 is a schematic perspective view showing a part of a woven fabric comprising three side emission type optical fibers woven in juxtaposition as first constituent yarns, in which a twist-preventing yarn is interposed between the respective side emission type optical fibers.
Figure 5:
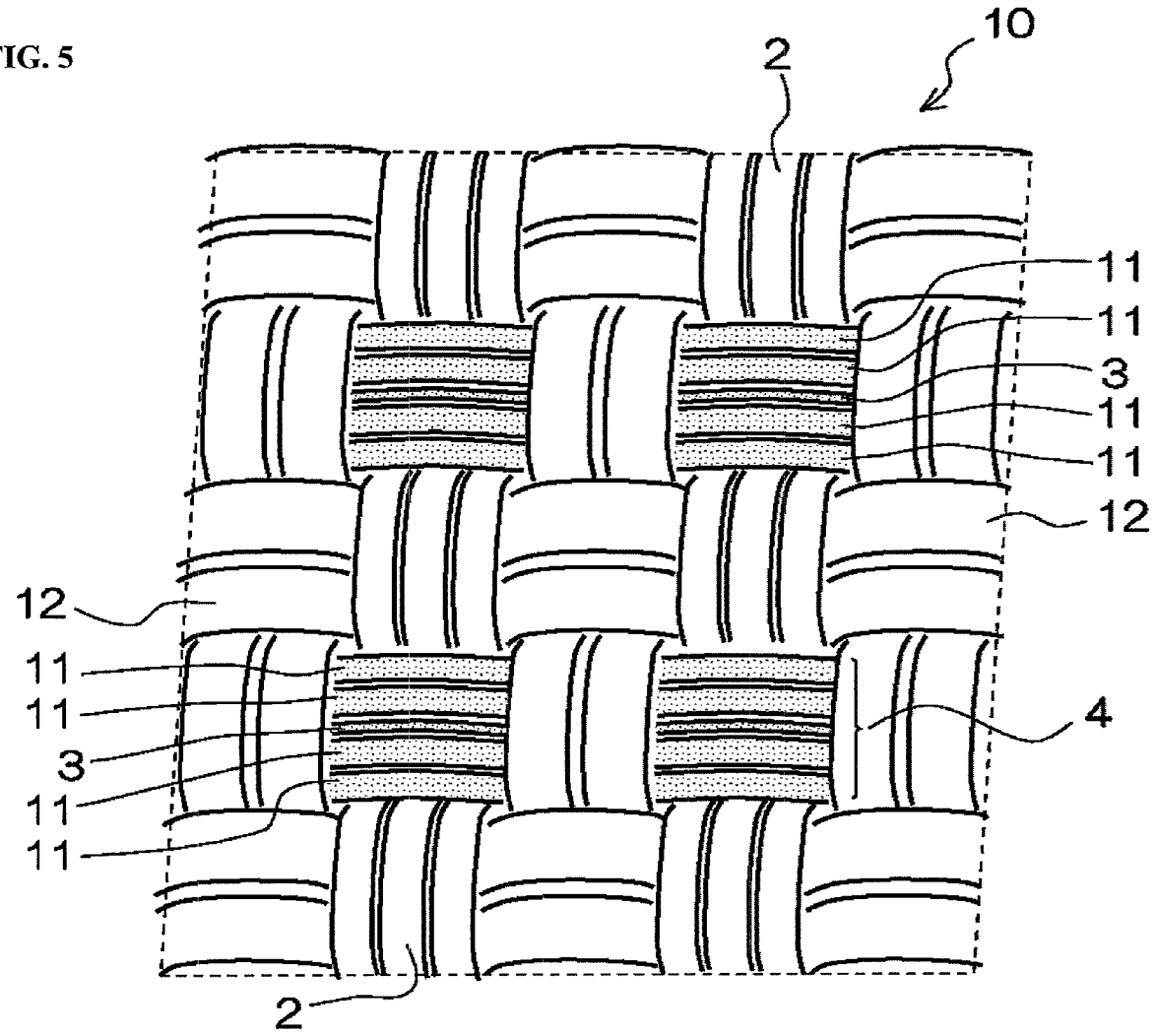
FIG. 5 is schematic perspective view showing a part of a woven fabric comprising four side emission type optical fibers woven in juxtaposition as first constituent yarns, in which a twist-preventing yarn is interposed between the respective two side emission type optical fibers woven adjacent to each other.

On the other hand, when the number of the side emission type optical fibers 11 exceeds 15, a sufficiently large light emission part 4 can be formed, and there is no problem from the viewpoint of designability. However, the woven fabric 10 is deteriorated in strength and thus cannot be practical. Further, when the number of the side emission type optical fibers 11 is 3 or more, twisting occurs between the adjacent side emission type optical fibers 11, and the positions thereof are switched so that a convex part a is formed (see. FIG. 3). Therefore, the light emission part 4 has a light emission site having locally high luminance, thereby deteriorating the designability. This site having locally high luminance can be visually recognized even when not allowed to emit light, the woven fabric 10 has bad looking even at the time of no light emission.

In order to prevent the twisting and positional switching of the adjacent side emission type optical fibers 11 as described above, there is indicated a form such that (1) a twist-preventing yarn 3 is woven and interposed between the adjacent two side emission type optical fibers 11. Further, there are indicated forms such that a twist-preventing yarn 3 is woven and interposed (2) between two sets of the adjacent two side emission type optical fibers 11 or (3) between the one side emission type optical fiber 11 and one set of the adjacent two side emission type optical fibers 11.

The form in which the twist-preventing yarn 3 is interposed may be any of the above forms (1), (2) and (3), but the form (1) is preferred because it makes it possible to more reliably prevent the twisting and positional switching of the side emission type optical fibers 11 and to produce a woven fabric 10 having sufficient strength and a stable shape. In the case of the form (2) or (3), on the other hand, the side emission type optical fibers 11 easily appear at the light emission part 4, thereby making it possible to form a more distinct light emission part 4 and to produce a woven fabric 10 having no particular problem with strength or shape stability.

The light emission part 4 is formed of the continuous side emission type optical fibers 11 appearing on a design surface side by the second constituent yarns 2 intersecting the side emission type optical fibers 11 on a non-design surface side. The number of the side emission type optical fibers 11 intersecting the continuous second constituent yarns 2 on the non-design surface side is not particularly limited so long as a distinct light emission part 4 is formed and there is no problem with the strength or shape stability of the woven fabric 10, but is preferably 2 to 8, more preferably 3 to 7.

Further, the ratio of the diameter ($d_1$) of the side emission type optical fibers 11 to the diameter ($d_2$) of the twist-preventing yarn 3 is not particularly limited unless an indistinct light emission part 4 is formed due to shielding of the light emission from the side emission type optical fibers 11 by the twist-preventing yarn 3, or a light emission part 4 having low luminance is formed. The ratio ($d_1/d_2$) of the diameter ($d_1$) of the side emission type optical fibers 11 to the diameter ($d_2$) of the twist-preventing yarn 3 preferably ranges from 1.2 to 20.0.

Further, the ratio ($f_1/f_2$) of the fineness ($f_1$) of the second constituent yarns 2 to the fineness ($f_2$) of the twist-preventing yarn 3 preferably ranges from 0.05 to 20.0. More specifically, for example, the fineness ($f_1$) of the second constituent yarns 2 can be defined within the range of 50 to 1000 dtex; the fineness ($f_2$) of the twist-preventing yarn 3 can be defined within the range of 50 to 1000 dtex; and the ratio $f_1/f_2$ can be defined within the range of 0.05 to 20.0. Thus, it is possible to suppress the twisting and positional switching of the side emission type optical fibers 11 caused by the tension of the second constituent yarns 2 and to produce a woven fabric 10 having sufficient strength and shape stability.

Further, the fineness ($f_1$) of other constituent yarns 12 except the twist-preventing yarn 3, among the first constituent yarns 1, is not particularly limited, and may be either equivalent to the fineness of the second constituent yarns 2 or as small as that of the twist-preventing yarn 3.

Side emission type optical fibers 1, emitting light, but light leaks at the side parts, are normally composed of a core layer and a clad layer, and have a structure such that the outer periphery of the core layer is covered by the clad layer. Also, the core layer and the clad layer may each be either a single layer or a laminate of a plurality of layers. Side emission type optical fibers 1, for example, are configured so that dispersing light leaks to the external at the side parts by including a light dispersing agent in the core layer without total reflection at the interface between the core layer and the clad layer, and dispersing light leaks to the external at the side parts by being removed a part of the clad layer. In addition, examples of the side emission type optical fibers 1 include various optical fibers such as optical fibers made of a resin and quartz-based optical fibers. The optical fibers used in the present invention are woven in the woven fabric 10, and thus are preferably optical fibers made of a resin, which are flexible, have excellent bending impact and the like and can be easily woven.

Also, the side emission type optical fibers 11 such as the existing optical fibers made of a resin have a diameter of about 0.1 to 10 mm. However, the side emission type optical fibers 11 preferably have a large diameter in order to form a light emission part 4 which is distinct and excellent in designability, and preferably have a small diameter from the viewpoint of easiness to weave. When these are taken into consideration together, the diameter of the side emission type optical fibers 11 preferably ranges from 0.25 to 3.0 mm, more preferably ranges from 0.25 to 1.0 mm.

Further, in order to allow the side emission type optical fibers 11 woven in the woven material 10 to emit light, the tip end parts of a plurality of side emission type optical fibers 11 are bundled together, and a light source is arranged at a position facing their end surfaces. The light source is not especially limited, but LED is normally used. Light is delivered and guided from the LED light source toward the end surfaces of the side emission type optical fibers 11 bundled together, so that the side emission type optical fibers 11 emit light, leading to the formation of a light emission part 4. Also, when the tip end parts of the plurality of side emission type optical fibers 11 are bundled together, all the side emission type optical fibers 11 woven in the woven fabric 10 may be bundled together. However, a plurality of side emission type optical fiber bundles in which a predetermined number of the side emission type optical fibers 11 are bundled together are normally employed.

As the core layer of the optical fibers made of a resin, there are preferably used resins having excellent transparency: for example, acrylic resins such as polymethyl methacrylate, polyethyl methacrylate and polyethyl acrylate; polycarbonate resins; polystyrene resins; and polyolefin-based resins. Further, as the clad layer, there are preferably used resins having excellent transparency and a refractive index smaller than that of the core layer: for example, vinylidene fluoride resins, vinylidene fluoride-tetrafluoroethylene copolymer resins, polychlorotrifluoroethylene resins and trifluoroisopropyl methacrylate resins.

Also, common multifilaments made of a synthetic resin can be used as the other first constituent yarns 12 except the side emission type optical fibers 11 and the second constituent yarns 2. The material for the multifilaments is not especially limited, and multifilaments made of various synthetic resins can be used. Examples of this synthetic resin include: polyamide-based resins such as nylon 6 and nylon 66; polyester-based resins such as polyethylene terephthalate, polybutylene terephthalate and polytrimethylene terephthalate; polyacrylic resins; and polyolefin-based resins such as polypropylene. As the synthetic resin, a polyamide-based resin and a polyester-based resin are especially preferred.

Further, a filament made of a synthetic resin can also be used as the twist-preventing yarn 3. A multifilament or monofilament can be used as the twist-preventing yarn 3. However, since it is unnecessary to consider the improvement in designability of the woven fabric 10 by the twist-preventing yarn 3, a multifilament made of a synthetic resin, which is advantageous in cost, is preferably used.

The loom used for weaving the woven fabric 10 using the side emission type optical fibers 11 and the twist-preventing yarns 3 as warps or wefts is not particularly limited, and examples of this loom include a rapier loom (Models "G6500, R9500" manufactured by Itema Weaving Ltd. (Italy)), a jacquard loom (Models "CX880, DX110, LX1602, SXB" manufactured by STÄUBLI (France)) and a dobby loom (Model "UVIVAL500" manufactured by STÄUBLI (France)).

Further, the intended use of the woven fabric 10 is not especially limited, and the woven fabric 10 can be used, for example, as a skin material for vehicle interior. In this case, the woven fabric is adhered to a substrate for vehicle interior to form a design surface in a vehicle compartment. The substrate for vehicle interior is normally a molded body made of a synthetic resin, and molded into a shape of a vehicle interior material such as a door trim or a roof trim by a press-molding method involving heating and pressurization by means of a molding die.

Also, the synthetic resin used to mold the substrate for vehicle interior is not especially limited, and polyolefin resins such as polyethylene and polypropylene and polyamide resins such as nylon 6 and nylon 66 are used. Among these synthetic resins, polypropylene is preferred from the viewpoint of easiness to mold, strength and the like. Also, a fiber reinforced resin including glass fiber, carbon fiber or the like can be used in order to improve the physical properties such as rigidity.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although particular structures, materials and embodiments of the present invention have been described in detail and referred to herein, the present invention is not intended to be limited to the particulars disclosed herein; rather, the present invention extends to all functionally equivalent structures, methods and uses, such as are within the scope of the appended claims.

The present invention can be utilized especially in the technical field of woven fabrics which include a plurality of dot-shaped light emission parts, are used, for example, as skin materials for vehicle interior, and are usable to form a design surface in a vehicle compartment. Especially, the present invention is useful in the technical field of skin materials for vehicle interior materials such as a door trim and a roof trim.

What is claimed is:

1. A woven fabric woven from first constituent yarns as one of warps and wefts and second constituent yarns as the other, wherein a part of the first constituent yarns are 2 to 15 side emission type optical fibers woven in juxtaposition; and when the number of the side emission type optical fibers is 3 or more, a twist-preventing yarn having a diameter smaller than that of the side emission type optical fibers is interposed between the one or two side emission type optical fibers and the one or two side emission type optical fibers.

2. The woven fabric according to claim 1, wherein the 2 to 8 continuous second constituent yarns intersect the side emission type optical fibers on a non-design surface side, and a light emission part is formed of the side emission type optical fibers appearing on a design surface side.

3. The woven fabric according to claim 2, wherein the ratio ($d_1/d_2$) of the diameter ($d_1$) of the side emission type optical fibers to the diameter ($d_2$) of the twist-preventing yarn ranges from 1.2 to 20.0.

4. The woven fabric according to claim 3, wherein the ratio ($f_1/f_2$) of the fineness ($f_1$) of the second constituent yarns to the fineness ($f_2$) of the twist-preventing yarn ranges from 0.05 to 20.0.

5. The woven fabric according to claim 4, wherein the twist-preventing yarn is a multifilament made of a synthetic resin.

6. The woven fabric according to claim 1, wherein the ratio ($d_1/d_2$) of the diameter ($d_1$) of the side emission type optical fibers to the diameter ($d_2$) of the twist-preventing yarn ranges from 1.2 to 20.0.

7. The woven fabric according to claim 6, wherein the ratio ($f_1/f_2$) of the fineness ($f_1$) of the second constituent yarns to the fineness ($f_2$) of the twist-preventing yarn ranges from 0.05 to 20.0.

8. The woven fabric according to claim 7, wherein the twist-preventing yarn is a multifilament made of a synthetic resin.

9. The woven fabric according to claim 2, wherein the ratio ($f_1/f_2$) of the fineness ($f_1$) of the second constituent yarns to the fineness ($f_2$) of the twist-preventing yarn ranges from 0.05 to 20.0.

10. The woven fabric according to claim 9, wherein the twist-preventing yarn is a multifilament made of a synthetic resin.

* * * * *